US008367288B2

(12) United States Patent
Tani et al.

(10) Patent No.: US 8,367,288 B2
(45) Date of Patent: Feb. 5, 2013

(54) YELLOW TONER

(75) Inventors: Yutaka Tani, Yokohama (JP); Yasuaki Murai, Kawasaki (JP); Takayuki Toyoda, Yokohama (JP); Masahiro Suenaga, Yokohama (JP); Masatake Tanaka, Yokohama (JP); Taichi Shintou, Saitama (JP); Kei Inoue, Tokyo (JP); Masashi Kawamura, Tokyo (JP); Masashi Hirose, Machida (JP); Takeshi Miyazaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 249 days.

(21) Appl. No.: 12/766,756

(22) Filed: Apr. 23, 2010

(65) Prior Publication Data

US 2010/0273101 A1 Oct. 28, 2010

(30) Foreign Application Priority Data

Apr. 27, 2009 (JP) ..... 2009-107833

(51) Int. Cl.
*G03G 9/09* (2006.01)

(52) U.S. Cl. ..... 430/108.23; 430/108.1; 430/108.2; 430/108.21

(58) Field of Classification Search ..... 430/108.1, 430/108.2, 108.21, 108.23
See application file for complete search history.

(56) References Cited

U.S. PATENT DOCUMENTS

| | | | |
|---|---|---|---|
| 6,117,606 | A | 9/2000 | Macholdt et al. |
| 2007/0215008 | A1 * | 9/2007 | Schweikart et al. ..... 106/496 |

FOREIGN PATENT DOCUMENTS

| | | | |
|---|---|---|---|
| JP | S56-13945 | B | 4/1981 |
| JP | S59-53856 | A | 3/1984 |
| JP | S59-61842 | A | 4/1984 |
| JP | H11-184146 | A | 7/1999 |
| JP | 2001-109196 | A | 4/2001 |
| JP | 2001-166540 | A | 6/2001 |
| JP | 2003-128952 | A | 5/2003 |
| JP | 2005-350600 | * | 12/2005 |
| JP | 3917764 | B | 5/2007 |
| JP | 2007-155861 | A | 6/2007 |
| JP | 2007-262382 | A | 10/2007 |
| JP | 4011476 | B | 11/2007 |
| JP | 4092905 | B | 5/2008 |
| WO | 99/42532 | A | 8/1999 |

OTHER PUBLICATIONS

Translation of JP 2005-350600 published Dec. 2005.*
Diamond, "The Handbook of Imaging Materials," Marcel Dekker, NY, NY 1991.*

* cited by examiner

*Primary Examiner* — Peter Vajda
(74) *Attorney, Agent, or Firm* — Canon U.S.A., Inc., IP Division

(57) ABSTRACT

To provide a yellow toner satisfying good toner particles and a superior coloring power, the toner has toner base particles having at least a binder resin, a colorant and a wax component, and contains as the colorant at least a coloring matter compound represented by the following general formula (1) and a pigment represented by the following formula (2).

(General formula (1)
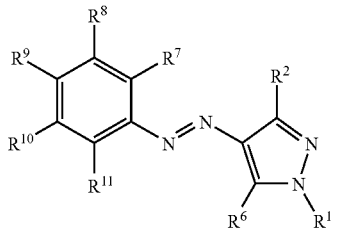
Formula (2)
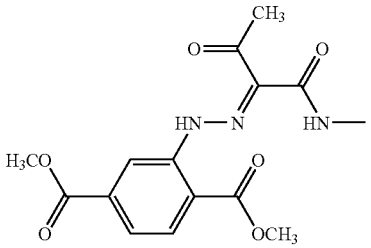
-continued
(2)
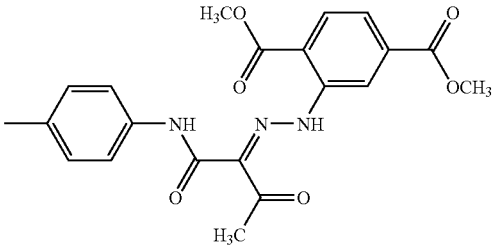
14 Claims, 3 Drawing Sheets

YELLOW TONER

BACKGROUND OF THE INVENTION

1. Field of the Invention

The present invention relates to a yellow toner used in electrophotography, electrostatic recording, electrostatic printing or toner jet recording.

2. Description of the Related Art

In recent years, image forming apparatus that utilize electrophotography have made progress toward full-color image formation and toward digitization, and have come to be put into professional use in, e.g., design studios and be used as color copying machines for office work processing. Further, they have also come to be used as printers for computer outputting or printers for personal use.

With spread of such uses, it is sought to achieve a much higher image quality that can satisfy higher definition and higher resolution, and it is desired to make an advance of colorants for toner which have small particle diameters and a narrow particle size distribution and further have good spectral characteristics, coloring power, transparency and so forth.

Where azo pigments are used as colorants for yellow toner, it is necessary for them to be finely dispersed in mediums of various types so as to be provided with suitable properties such as coloring power and transparency. However, when made fine, the azo pigments commonly tend to cause crystal growth or transition because of their heat history or contact with solvents in the step of dispersion or in subsequent steps for toner production, so that they may bring about a problem such as a lowering of coloring power or transparency.

Examples are disclosed in which a disazo pigment C.I. Pigment Yellow 155 is used as a colorant for toner (Japanese Patents No. 3917764, No. 4011476 and No. 4092905 and Japanese Patent Applications Laid-open No. 2001-166540 and No. 2001-109196). It is disclosed that this pigment has relatively good spectral characteristics and toners can be produced by using a polymerization or pulverization process of various types. This pigment, however, is so strongly agglomerative in itself and so poorly stable in handling, in particular, in dispersion mediums, as to tend to cause a difficulty that the pigment comes to agglomerate in toners.

To deal with such a problem, diverse pigment compositions and pigment dispersants making up the compositions are proposed. For example, disclosed are i) a pigment composition made up of an azo pigment and an azo coloring matter different in type which has been added to the former as a pigment dispersant and ii) an example making use of SOLSPERSE (registered trademark; available from Lubrizol Corporation) as a pigment dispersant (Japanese Patent Application Laid-open No. 2003-128952 and International Publication No. 99/42532). These pigment composition and pigment dispersant, however, have been found not to be those which are well effectively dispersible when dispersed in organic solvents, in particular, non-polar solvents as exemplified by styrene or the like.

There is also a problem that, when used in a process for producing toner particles in an aqueous system, such as suspension granulation or suspension polymerization, the pigment dispersant migrates to the aqueous system to make the pigment low dispersible in a resin or in a polymerizable monomer (Japanese Patent Application Laid-open No. 2007-262382).

An example of a toner is disclosed which makes use of an aluminum coupling agent as a pigment dispersant (Japanese Patent Application Laid-open No. 2007-155861). In the toner obtained in this proposal, however, there is room for further improvement in regard to the achievement of both particle diameter and coloring power.

SUMMARY OF THE INVENTION

An object of the present invention is to provide a yellow toner having a superior coloring power.

The problems discussed above can be resolved by the present invention described below.

The present invention is concerned with a yellow toner which is a toner comprising toner base particles having a binder resin, a colorant and a wax component; the colorant comprising a coloring matter compound represented by the following general formula (1) and a pigment represented by the following formula (2):

General formula (1)

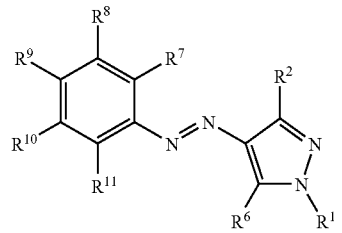

wherein; $R^1$ represents a hydrogen atom, an alkyl group, an aryl group or an aralkyl group; $R^2$ represents a hydrogen atom, an amino group, an alkyl group, an aryl group, a $COOR^3$ group ($R^3$ represents an alkyl group, an aryl group or an aralkyl group), a $CONR^4R^5$ group ($R^4$ represents an alkyl group, an aryl group or an aralkyl group, $R^5$ represents a hydrogen atom, an alkyl group, an aryl group or an aralkyl group, and $R^4$ and $R^5$ may form a heterocyclic ring together with a nitrogen atom) or a $COOM^1$ group ($M^1$ represents a hydrogen atom or a counter cation); $R^6$ represents a hydroxyl group or an amino group; $R^7$ to $R^{11}$ each independently represent a hydrogen atom, a halogen atom, a trifluoromethyl group, a nitro group, an acetylamino group, a sulfamoyl group, a hydroxyl group, an alkyl group, an alkoxyl group, a $COOR^{12}$ group ($R^{12}$ represents an alkyl group, an aryl group or an aralkyl group), a $CONR^{13}R^{14}$ group ($R^{13}$ represents an alkyl group, an aryl group or an aralkyl group, $R^{14}$ represents a hydrogen atom, an alkyl group, an aryl group or an aralkyl group, and $R^{13}$ and $R^{14}$ may form a heterocyclic ring together with a nitrogen atom), a $COOM^2$ group ($M^2$ represents a hydrogen atom or a counter cation) or an $SO_3OM^3$ group ($M^3$ represents a hydrogen atom or a counter cation); and the above $R^1$ to $R^{14}$ may each be further substituted and satisfy any of the following i) and ii): i) $R^2$ is the $CONR^4R^5$ group; and ii) at least one of $R^7$ to $R^{11}$ is the $COOR^{12}$ group or $CONR^{13}R^{14}$ group.

Formula (2)

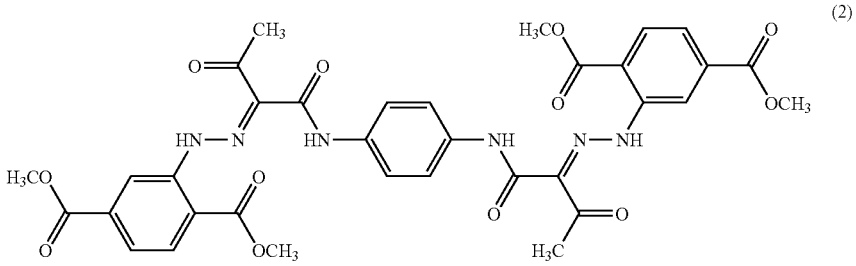

(2)

Further features of the present invention will become apparent from the following description of exemplary embodiments with reference to the attached drawings.

DESCRIPTION OF THE EMBODIMENTS

Figure 1:
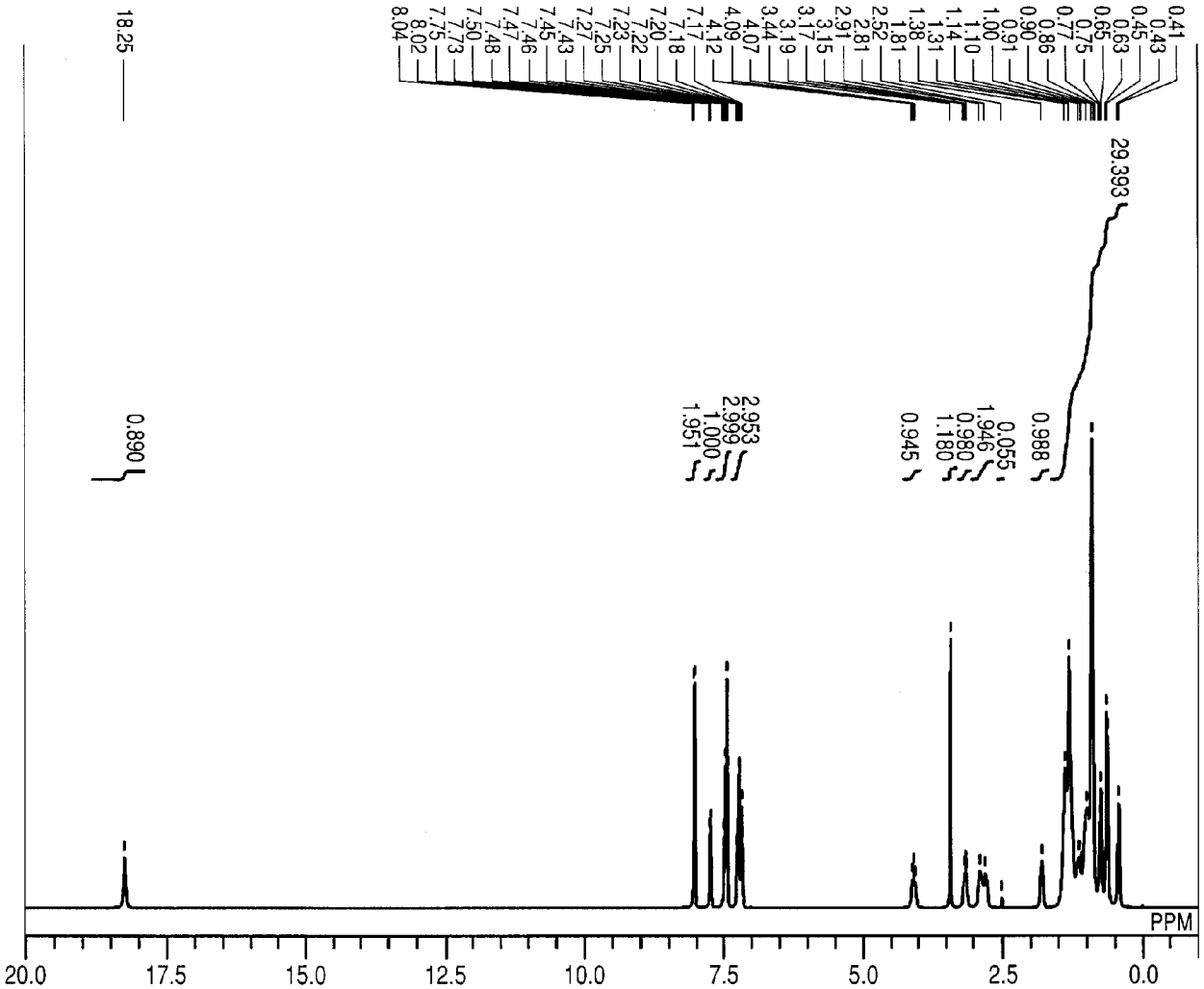
FIG. 1 is a graph showing a $^1$H-NMR spectrum in DMSO-$d_6$, at room temperature and at 400 MHz, of a coloring matter compound (10) used in the yellow toner of the present invention.

Preferred embodiments of the present invention will now be described in detail in accordance with the accompanying drawings.

As a result of expensive studies made in order to resolve the above problems the prior art has had, the present inventors have discovered that the coloring matter compound represented by the above general formula (1) has a high affinity for the azo pigment represented by the above formula (2). Then, it has been found that a yellow toner having a superior coloring power can be obtained by using a pigment composition made up of the coloring matter compound and the azo pigment.

The coloring matter compound contained in the yellow toner of the present invention is described first, which has structure represented by the following general formula (1).

General formula (1)

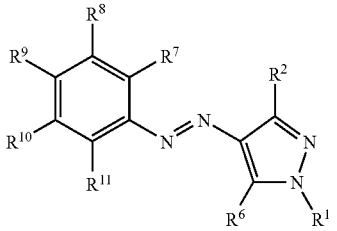

In the general formula (1); $R^1$ represents a hydrogen atom, an alkyl group, an aryl group or an aralkyl group; $R^2$ represents a hydrogen atom, an amino group, an alkyl group, an aryl group, a $COOR^3$ group ($R^3$ represents an alkyl group, an aryl group or an aralkyl group), a $CONR^4R^5$ group ($R^4$ represents an alkyl group, an aryl group or an aralkyl group, $R^5$ represents a hydrogen atom, an alkyl group, an aryl group or an aralkyl group, and $R^4$ and $R^5$ may form a heterocyclic ring together with a nitrogen atom) or a $COOM^1$ group ($M^1$ represents a hydrogen atom or a counter cation); $R^6$ represents a hydroxyl group or an amino group; $R^7$ to $R^{11}$ each independently represent a hydrogen atom, a halogen atom, a trifluoromethyl group, a nitro group, an acetylamino group, a sulfamoyl group, a hydroxyl group, an alkyl group, an alkoxyl group, a $COOR^{12}$ group ($R^{12}$ represents an alkyl group, an aryl group or an aralkyl group), a $CONR^{13}R^{14}$ group ($R^{13}$ represents an alkyl group, an aryl group or an aralkyl group, $R^{14}$ represents a hydrogen atom, an alkyl group, an aryl group or an aralkyl group, and $R^{13}$ and $R^{14}$ may form a heterocyclic ring together with a nitrogen atom), a $COOM^2$ group ($M^2$ represents a hydrogen atom or a counter cation) or an $SO_3OM^3$ group ($M^3$ represents a hydrogen atom or a counter cation); and the above $R^1$ to $R^{14}$ may each be further substituted and satisfy any of the following i) and ii): i) $R^2$ is the $CONR^4R^5$ group; and ii) at least one of $R^7$ to $R^{11}$ is the $COOR^{12}$ group or $CONR^{13}R^{14}$ group.

The alkyl group represented by $R^1$ in the general formula (1) may include, but is not particularly limited to, e.g., straight-chain, branched or cyclic alkyl groups such as a methyl group, an ethyl group, a n-propyl group, an isopropyl group, a n-butyl group, an isobutyl group, a sec-butyl group, a tert-butyl group, a pentyl group, a hexyl group, a 2-ethylhexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, a cyclopropyl group, a cyclobutyl group and a cyclopentyl group.

The aryl group represented by $R^1$ in the general formula (1) may include, but is not particularly limited to, e.g., a phenyl group, a naphthyl group, a phenanthryl group and an anthracenyl group.

The aralkyl group represented by $R^1$ in the general formula (1) may include, but is not particularly limited to, e.g., a benzyl group and a phenethyl group.

The $R^1$ in the general formula (1) represents the substituent including the foregoing, and any of these may be further substituted. The substituent that may be used as such a further substituent in such a case may include the following. It may include, e.g., straight-chain, branched or cyclic alkyl groups such as a methyl group, an ethyl group, a n-propyl group, an isopropyl group, a n-butyl group, an isobutyl group, a sec-butyl group, a tert-butyl group, a pentyl group, a hexyl group, a 2-ethylhexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, a cyclopropyl group, a cyclobutyl group and a cyclopentyl group; aryl groups such as a phenyl group, a naphthyl group, a pyridyl group, a triazinyl group and a benzothiazolyl group; straight-chain, branched or cyclic alkoxyl groups such as a methoxyl group, an ethoxyl group, a n-propoxyl group, an isopropoxyl group, a n-butoxyl group, an isobutoxyl group, a sec-butoxyl group, a tert-butoxyl group, a cyclopropoxyl group, a cyclobutoxyl group and a cyclopentyloxyl group; aryloxyl groups such as a phenoxyl group and a naphthyloxyl group; amino groups such as an N-methylamino group, an N-ethylamino group, an N,N-dimethylamino group, an N-ethyl-N-phenylamino group and an N,N-diphenylamino group; acyl groups such as an acetyl group and a benzoyl group; halogen atoms such as a fluorine atom, a chlorine atom, a bromine atom and an iodine atom; a trifluoromethyl group, a carbamoyl group, a sulfamoyl group, a nitro group, an acetylamino group, a hydroxyl group, a carboxylic acid group or a salt thereof, and a sulfonic acid group or a salt thereof. Of these, in view of an affinity for pigments, a case is preferable in which the substituent is a sulfamoyl group, a carboxylic acid group or a salt thereof, or a sulfonic acid group or a salt thereof.

The $R^1$ in the general formula (1) may arbitrarily be selected from the above substituents and a hydrogen atom. What is particularly preferable is a case in which the $R^1$ is a phenyl group, in view of a high affinity for organic components such as organic mediums and resin components (hereinafter also "affinity for mediums").

The amino group represented by $R^2$ in the general formula (1) may include, but is not particularly limited to, e.g., an unsubstituted amino group, mono-substituted amino groups such as an N-methylamino group, an N-butylamino group, an N-hexylamino group, an N-tetradecylamino group, an N-phenylamino group and an N-naphthylamino group; di-substituted amino groups such as an N,N-dimethylamino group, an N,N-diethylamino group, an N,N-diphenylamino group and an N-methyl-N-propylamino group; carbonylamino groups such as an acetylamino group, an ethylcarbonylamino group, a tert-butylcarbonylamino group, a benzoylamino group, a naphthoylamino group and a methoxycarbonylamino group; sulfonylamino groups such as a methylsulfonylamino group, an ethylsulfonylamino group, a tert-butylsulfonylamino group and an isopropoxysulfonylamino group. The amino group may also form a heterocyclic ring together with a carbon atom, which may specifically include a piperidine ring, a piperadine ring, a pyrrolidine ring and a morpholine ring.

The alkyl group represented by $R^2$ in the general formula (1) may include, but is not particularly limited to, e.g., straight-chain, branched or cyclic alkyl groups such as a methyl group, an ethyl group, a n-propyl group, an isopropyl group, a n-butyl group, an isobutyl group, a sec-butyl group, a tert-butyl group, a pentyl group, a hexyl group, a 2-ethylhexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, a cyclopropyl group, a cyclobutyl group and a cyclopentyl group.

The aryl group represented by $R^2$ in the general formula (1) may include, but is not particularly limited to, e.g., a phenyl group, a naphthyl group, a phenanthryl group, an anthracenyl group, a furyl group and a thienyl group.

In the $COOR^3$ group and $CONR^4R^5$ group represented by $R^2$ in the general formula (1), the alkyl group represented by any of $R^3$ to $R^5$ may include, but is not particularly limited to, e.g., straight-chain, branched or cyclic alkyl groups such as a methyl group, an ethyl group, a n-propyl group, an isopropyl group, a n-butyl group, an isobutyl group, a sec-butyl group, a tert-butyl group, a pentyl group, a hexyl group, a 2-ethylhexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, a cyclopropyl group, a cyclobutyl group and a cyclopentyl group.

In the $COOR^3$ group and $CONR^4R^5$ group represented by $R^2$ in the general formula (1), the aryl group represented by any of $R^3$ to $R^5$ may include, but is not particularly limited to, e.g., a phenyl group, a naphthyl group, a phenanthryl group and an anthracenyl group.

In the $COOR^3$ group and $CONR^4R^5$ group represented by $R^2$ in the general formula (1), the aralkyl group represented by any of $R^3$ to $R^5$ may include, but is not particularly limited to, e.g., a benzyl group and a phenethyl group.

In the $CONR^4R^5$ group represented by $R^2$ in the general formula (1), the $R^4$ and $R^5$ may form a heterocyclic ring together with a nitrogen atom. As specific examples of the heterocyclic ring the $R^4$ and $R^5$ may form together with a nitrogen atom may include a piperadine ring, a piperidine ring, a pyrrolidine ring and a morpholine ring.

In the $COOM^1$ group represented by $R^2$ in the general formula (1), the $M^1$ represents a hydrogen atom or a counter cation which is to form a salt. Such a counter cation may include, but is not particularly limited to, e.g., alkali metal ions such as lithium, sodium and potassium; and quaternary ammonium ions such as ammonium, methylammonium, dimethylammonium, trimethylammonium, tetramethylammonium, ethylammonium, diethylammonium, triethylammonium, tetraethylammonium, n-propylammonium, isopropylammonium, diisopropylammonium, n-butylammonium, tetra-n-butylammonium, isobutylammonium, monoethanolammonium, diethanolammonium and triethanolammonium.

The $R^2$ and $R^3$ to $R^5$ in the general formula (1) represent the substituent including the foregoing, and any of these may be further substituted. The substituent that may be used as such a further substituent in this case may include the following. It may include, e.g., straight-chain, branched or cyclic alkyl groups such as a methyl group, an ethyl group, a n-propyl group, an isopropyl group, a n-butyl group, an isobutyl group, a sec-butyl group, a tert-butyl group, a pentyl group, a hexyl group, a 2-ethylhexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, a cyclopropyl group, a cyclobutyl group and a cyclopentyl group; aryl groups such as a phenyl group, a naphthyl group, a pyridyl group, a triazinyl group and a benzothiazolyl group; straight-chain, branched or cyclic alkoxyl groups such as a methoxyl group, an ethoxyl group, a n-propoxyl group, an isopropoxyl group, a n-butoxyl group, an isobutoxyl group, a sec-butoxyl group, a tert-butoxyl group, a cyclopropoxyl group, a cyclobutoxyl group and a cyclopentyloxyl group; aryloxyl groups such as a phenoxyl group and a naphthyloxyl group; amino groups such as an N-methylamino group, an N-ethylamino group, an N,N-dimethylamino group, an N-ethyl-N-phenylamino group and an N,N-diphenylamino group; acyl groups such as an acetyl group and a benzoyl group; halogen atoms such as a fluorine atom, a chlorine atom, a bromine atom and an iodine atom; a trifluoromethyl group, a carbamoyl group, a sulfamoyl group, a nitro group, an acetylamino group, a hydroxyl group, a carboxylic acid group or a salt thereof, and a sulfonic acid group or a salt thereof.

The $R^2$ in the general formula (1) may arbitrarily be selected from the above substituents and a hydrogen atom. What is particularly preferable is the $CONR^4R^5$ group in view of a high affinity for mediums. Also, in view of an advantage that such a high affinity for mediums is achievable, the total number of carbon atoms of the $R^4$ and $R^5$ may preferably be 8 or more and 16 or less, and much preferably 10 or more and 16 or less.

As will be detailed later, a case in which any of the $R^7$ to $R^{11}$ is the $COOR^{12}$ group or the $CONR^{13}R^{14}$ group, the affinity for organic components can be made higher in virtue of the action of their functional groups. In such a case, any substituent other than the $CONR^4R^5$ group may preferably be used as the $R^2$. A case in which the $R^2$ is an alkyl group having 1 to 4 carbon atoms is also preferable in view of an advantage that an affinity for pigments can be better prevented from lowering. Further, a case in which the $R^2$ is the $COOM^1$ group is also preferable in view of a low migration to water (of the coloring matter compound) during the production of the toner.

The amino group represented by $R^6$ in the general formula (1) may include, but is not particularly limited to, e.g., an unsubstituted amino group, mono-substituted amino groups such as an N-methylamino group, an N-butylamino group, an N-hexylamino group, an N-tetradecylamino group, an N-phenylamino group and an N-naphthylamino group; di-substituted amino groups such as an N,N-dimethylamino group, an N,N-diethylamino group, an N,N-diphenylamino group and an N-methyl-N-propylamino group; carbonylamino groups such as an acetylamino group, an ethylcarbonylamino group, a tert-butylcarbonylamino group, a benzoylamino group, a naphthoylamino group and a methoxycarbonylamino group; and sulfonylamino groups such as a methylsulfonylamino group, an ethylsulfonylamino group, a tert-butylsulfonylamino group and an isopropoxysulfonylamino group.

The $R^6$ in the general formula (1) may arbitrarily be selected from the above amino groups and a hydroxyl group. What is particularly preferable in view of a high affinity for pigments is a case in which the $R^6$ is an unsubstituted amino group or a hydroxyl group. Further, where the $R^2$ in the general formula (1) is the $CONR^4R^5$ group, the amino group or the $COOM^1$ group, it is particularly preferable from the viewpoint of the affinity for pigments that the $R^6$ is a hydroxyl group. Also, where the $R^2$ in the general formula (1) is the alkyl group having 1 to 4 carbon atoms, it is particularly preferable from the viewpoint of the affinity for pigments that the $R^6$ is an amino group.

The halogen atom represented by any of $R^7$ to $R^{11}$ in the general formula (1) may include a fluorine atom, a chlorine atom, a bromine atom and an iodine atom.

The alkyl group represented by any of $R^7$ to $R^{11}$ in the general formula (1) may include, but is not particularly limited to, e.g., straight-chain, branched or cyclic alkyl groups such as a methyl group, an ethyl group, a n-propyl group, an isopropyl group, a n-butyl group, an isobutyl group, a sec-butyl group, a tert-butyl group, a pentyl group, a hexyl group, a 2-ethylhexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, a cyclopropyl group, a cyclobutyl group and a cyclopentyl group.

The alkoxyl group represented by any of $R^7$ to $R^{11}$ in the general formula (1) may include, but is not particularly limited to, e.g., straight-chain, branched or cyclic alkoxyl groups such as a methoxyl group, an ethoxyl group, a n-propoxyl group, an isopropoxyl group, a n-butoxyl group, an isobutoxyl group, a sec-butoxyl group, a tert-butoxyl group, a pentyloxyl group, a hexyloxyl group, a heptyloxyl group, an octyloxyl group, a nonyloxyl group, a decyloxyl group, an undecyloxyl group, a dodecyloxyl group, a tridecyloxyl group, a tetradecyloxyl group, a pentadecyloxyl group, a hexadecyloxyl group, a heptadecyloxyl group, an octadecyloxyl group, a nonadecyloxyl group, a cyclopropoxyl group, a cyclobutoxyl group and a cyclopentyloxyl group.

In the $COOR^{12}$ group and $CONR^{13}R^{14}$ group represented by any of $R^7$ to $R^{11}$ in the general formula (1), the alkyl group represented by any of the $R^{12}$ to $R^{14}$ may include, but is not particularly limited to, e.g., straight-chain, branched or cyclic alkyl groups such as a methyl group, an ethyl group, a n-propyl group, an isopropyl group, a n-butyl group, an isobutyl group, a sec-butyl group, a tert-butyl group, a pentyl group, a hexyl group, a 2-ethylhexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, a cyclopropyl group, a cyclobutyl group and a cyclopentyl group.

In the $COOR^{12}$ group and $CONR^{13}R^{14}$ group represented by any of $R^7$ to $R^{11}$ in the general formula (1), the aryl group represented by any of the $R^{12}$ to $R^{14}$ may include, but is not particularly limited to, e.g., a phenyl group, a naphthyl group, a phenanthryl group, an anthracenyl group and a 3-(1-methyl-1-phenylethyl)phenyl group.

In the $COOR^{12}$ group and $CONR^{13}R^{14}$ group represented by any of $R^7$ to $R^{11}$ in the general formula (1), the aralkyl group represented by any of the $R^{12}$ to $R^{14}$ may include, but is not particularly limited to, e.g., a benzyl group and a phenethyl group.

In the $CONR^{13}R^{14}$ group represented by any of $R^7$ to $R^{11}$ in the general formula (1), the $R^{13}$ and $R^{14}$ may form a heterocyclic ring together with a nitrogen atom. As specific examples of the heterocyclic ring the $R^{13}$ and $R^{14}$ may form together with a nitrogen atom may include a piperadine ring, a piperidine ring, a pyrrolidine ring and a morpholine ring.

In the $COOM^2$ group and $SO_3OM^3$ group represented by any of $R^7$ to $R^{11}$ in the general formula (1), the $M^2$ and $M^3$ each represent a hydrogen atom or a counter cation which is to form a salt. Such a counter cation may include, but is not particularly limited to, e.g., alkali metal ions such as lithium, sodium and potassium; and quaternary ammonium ions such as ammonium, methylammonium, dimethylammonium, trimethylammonium, tetramethylammonium, ethylammonium, diethylammonium, triethylammonium, tetraethylammonium, n-propylammonium, isopropylammonium, diisopropylammonium, n-butylammonium, tetra-n-butylammonium, isobutylammonium, monoethanolammonium, diethanolammonium and triethanolammonium.

Other substituent represented by any of $R^7$ to $R^{11}$ in the general formula (1) may include a trifluoromethyl group, a nitro group, a sulfamoyl group and a hydroxyl group.

The $R^7$ to $R^{11}$ and $R^{12}$ to $R^{14}$ in the general formula (1) represent the substituent including the foregoing, and any of these may be further substituted. The substituent that may be used as such a further substituent in this case may include the following. It may include, e.g., straight-chain, branched or cyclic alkyl groups such as a methyl group, an ethyl group, a n-propyl group, an isopropyl group, a n-butyl group, an isobutyl group, a sec-butyl group, a tert-butyl group, a pentyl group, a hexyl group, a 2-ethylhexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, a cyclopropyl group, a cyclobutyl group and a cyclopentyl group; aryl groups such as a phenyl group, a naphthyl group, a pyridyl group, a triazinyl group and a benzothiazolyl group; straight-chain, branched or cyclic alkoxyl groups such as a methoxyl group, an ethoxyl group, a n-propoxyl group, an isopropoxyl group, a n-butoxyl group, an isobutoxyl group, a sec-butoxyl group, a tert-butoxyl group, a cyclopropoxyl group, a cyclobutoxyl group and a cyclopentyloxyl group; aryloxyl groups such as a phenoxyl group and a naphthyloxyl group; amino groups such as an N-methylamino group, an N-ethylamino group, an N,N-dimethylamino group, an N-ethyl-N-phenylamino group and an N,N-diphenylamino group; acyl groups such as an acetyl group and a benzoyl group; halogen atoms such as a fluorine atom, a chlorine atom, a bromine atom and an iodine atom; a trifluoromethyl group, a carbamoyl group, a sulfamoyl group, a nitro group, an acetylamino group, a hydroxyl group, a carboxylic acid group or a salt thereof, and a sulfonic acid group or a salt thereof.

The $R^7$ to $R^{11}$ in the general formula (1) may each independently arbitrarily be selected from the above substituents and a hydrogen atom. What is preferable is the $COOR^{12}$ group or $CONR^{13}R^{14}$ group in view of a high affinity for mediums. Further, the number of carbon atoms of the $R^{12}$ and the total number of carbon atoms of the $R^{13}$ and $R^{11}$ may each preferably be 8 or more and 24 or less, more preferably be 8 or more and 16 or less. The $COOM^2$ group is also preferable in view of an especially low migration to water during the production of the toner. Also, any four substituents among the $R^7$ to $R^{11}$ may be hydrogen atoms, and this is preferable in view of an advantage that both the affinity for pigments and the affinity for mediums are well achievable.

The coloring matter compound represented by the general formula (1) is, in view of a high affinity for mediums, required to satisfy any one of the following i) and ii). Introduction of any of these substituents into the compound at its stated position can improve the affinity for mediums, improve the dispersibility of pigment in toner particles and improve the coloring power required as the toner. i) $R^2$ is the $CONR^4R^5$ group; and ii) at least one of $R^7$ to $R^{11}$ is the $COOR^{12}$ group or $CONR^{13}R^{14}$ group.

The coloring matter compound represented by the general formula (1) according to the present invention may be synthesized by a known process. An example of a synthesis scheme is shown below.

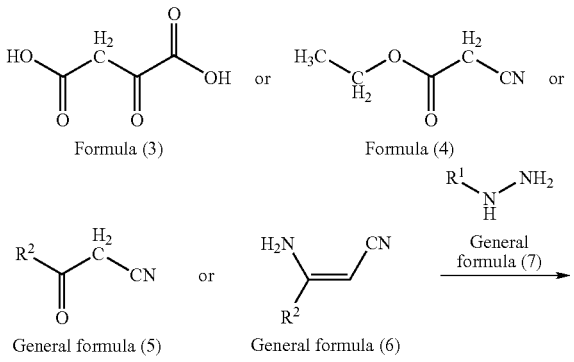

-continued

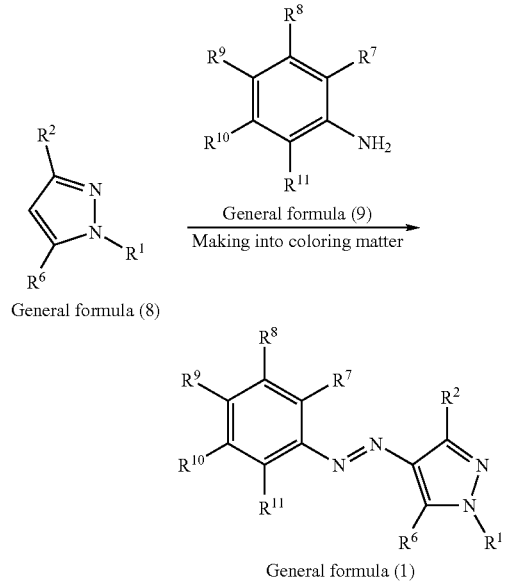

($R^1$, $R^2$ and $R^6$ to $R^{11}$ in the general formulas (5) to (9) represent the same functional groups as the $R^1$, $R^2$ and $R^6$ to $R^{11}$ in the general formula (1). The starting materials, compounds represented by the formulas (3) to (6), are not limited to these as long as they are equivalent derivatives which, e.g., may differ in protective groups.

In the above synthesis scheme, whether the substituent $R^6$ is an OH group or an $NH_2$ group may differ by what is chosen as synthesis precursors, the compounds represented by the formulas (3) to (6).

Where the compound represented by the formula (3) or formula (4) is allowed to react with the compound represented by the general formula (7), the compound represented by the general formula (8) is obtained as a pyrazolone derivative in which the $R^6$ is an OH group. Also, where the compound represented by the general formula (5) or general formula (6) is allowed to react with the compound represented by the general formula (7), the compound represented by the general formula (8) is obtained as an aminopyrazole derivative in which the $R^6$ is an $NH_2$ group.

The compound represented by the formula (3) or formula (4) is an active methylene compound, which may differ in its carboxylic acid and its substituent (protective group) at the ester moiety thereof. As specific examples of what differs in the protective group, it may include dimethyl oxalacetate, diethyl oxalacetate, di-n-propyl oxalacetate, diisopropyl oxalacetate, di-n-butyl oxalacetate, diisobutyl oxalacetate, di-sec-butyl oxalacetate, di-tert-butyl oxalacetate, cyanoacetic acid, methyl cyanoacetate, n-propyl cyanoacetate, isopropyl cyanoacetate, n-butyl cyanoacetate, isobutyl cyanoacetate, sec-butyl cyanoacetate and tert-butyl cyanoacetate.

The nitrile represented by the general formula (5) or general formula (6) is commercially available in great variety, and is available with ease. It may also be synthesized with ease by a known process (see, e.g., J. Am. Chem. Soc., Vol. 79, pages 723-725, 1957). As specific examples of the compound represented by the general formula (5) or general formula (6), it may include, but is not particularly limited to, e.g., 3-oxobutanenitrile, 3-oxohexanenitrile, 4-methyl-3-oxopentanenitrile, pivaloylacetonitrile, benzoylacetonitrile, 2-chlorobenzoylacetonitrile, 1-naphthoylacetonitrile and 3-aminochloronitrile.

The pyrazolone derivative or aminopyrazole derivative represented by the general formula (8), used in the present invention, is commercially available in great variety, and is available with ease, which may also optionally be synthesized with ease by a known process. In regard to the synthesis, it is disclosed in, e.g., J. Med. Chem., Vol. 44, No. 22, pages 3730-3745, 2001; J. Am. Chem. Soc., Vol. 81, pages 2456-2464, 1959; or J. Heterocycl. Chem., Vol. 12, pages 899-901, 1975.

A process for producing the coloring matter compound represented by the general formula (1) may be carried out by a known diazo coupling process. More specifically, the pyrazolone derivative or aminopyrazole derivative represented by the general formula (8) is coupled with a diazo component derived from an aniline derivative represented by the general formula (9), to obtain the coloring matter compound represented by the general formula (1). A specific coupling process may include a process shown below.

First, the aniline derivative represented by the general formula (9) is allowed to react with a nitrite such as sodium nitrite in methanol and in the presence of an inorganic acid such as hydrochloric acid or sulfuric acid so as to be converted into a corresponding diazonium salt. Further, this diazonium salt is coupled with the pyrazolone derivative or aminopyrazole derivative represented by the general formula (8), to produce the coloring matter compound represented by the general formula (1). Incidentally, the coupling reaction is by no means limited to this process.

The coloring matter compound represented by the general formula (1), obtained through the above reaction may be isolated and purified by using a conventional organic-compound isolation and purification method. For example, the reaction solution is made acidic with hydrochloric acid or the like, and a solid is filtered by acid deposition, where the solid thus separated by filtration is extracted with a solvent, followed by neutralization with an aqueous sodium hydroxide solution or the like, and then the solvent is concentrated, thus a crude product is obtained. Further, this crude product is purified by recrystallization making use of chloroform or n-heptane or by column chromatography making use of silica gel. Such a method may be used alone or in combination of two or more to make purification, whereby a highly pure product can be obtained.

The coloring matter compound represented by the general formula (1), thus obtained, may be examined for its purity by high-speed liquid chromatography (HPLC) (LC-20A, manufactured by Shimadzu Corporation). Its structure may also be determined by using a Time-of-Flight mass spectrometer (TOF-MS) (LC/MSD TOF, manufactured by Agilent Technologies Inc.) and a nuclear magnetic resonance (NMR) spectroscopic analyzer (ECA-400, manufactured by JEOL Ltd.)

Here, in making mass spectroscopy of the coloring matter compound represented by the general formula (1), electrospray ionization (ESI) is used as a method of ionizing the coloring matter compound.

The coloring matter compound represented by the general formula (1) can be synthesized by the above production process. As examples of the coloring matter compound represented by the general formula (1), Compounds (10) to (89) are shown in Table 1 below. Examples are by no means limited to the following. In Table 1, "Ph" means an unsubstituted phenyl group, and "Bn" an unsubstituted benzyl group. Symbol "*" indicates a linking site.

TABLE 1

Coloring matter compound used in the present invention:

| Comp No. | $R_1$ | $R_2$ | $R_6$ | $R_7$ | $R_8$ | $R_9$ | $R_{10}$ | $R_{11}$ |
|---|---|---|---|---|---|---|---|---|
| 10 | Ph | COONa | OH | H | H | H | H | $CON(CH_2CH(C_2H_5)C_4H_9)_2$ |
| 11 | Ph | COONa | OH | H | H | H | $CON(CH_2CH(C_2H_5)C_4H_9)_2$ | H |
| 12 | Ph | COONa | OH | H | H | $CON(CH_2CH(C_2H_5)C_4H_9)_2$ | H | H |
| 13 | Ph | COONa | OH | H | H | $CONCH_3Ph$ | H | H |
| 14 | Ph | COONa | OH | H | $COOCH_2CH(C_2H_5)C_4H_9$ | H | H | $COOCH_2CH(C_2H_5)C_4H_9$ |
| 15 | Ph | $NH_2$ | OH | H | H | H | H | $CON(CH_2CH(C_2H_5)C_4H_9)_2$ |
| 16 | Ph | $NH_2$ | OH | H | $COOCH_2CH(C_2H_5)C_4H_9$ | H | H | $COOCH_2CH(C_2H_5)C_4H_9$ |
| 17 | 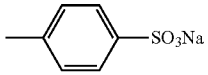 | COONa | OH | H | H | H | H | $CON(CH_2CH(C_2H_5)C_4H_9)_2$ |
| 18 | 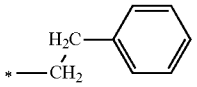 | COONa | OH | H | H | H | H | $CON(CH_2CH(C_2H_5)C_4H_9)_2$ |
| 19 | Ph | COONa | OH | H | $CON(C_6H_{13})_2$ | H | H | $CON(C_6H_{13})_2$ |
| 20 | Ph | COONa | OH | H | H | $CON(Bn)_2$ | H | H |
| 21 | Ph | COONa | OH | H | H | CONBnPh | H | H |
| 22 | Ph | COONa | OH | H | H | H | H | 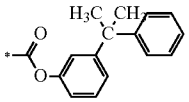 |
| 23 | Ph | COONa | OH | H | H | H | H | COOBn |
| 24 | Ph | COOH | OH | H | H | H | H | $CON(CH_2CH(C_2H_5)C_4H_9)_2$ |
| 25 | Ph | $COONH_4$ | OH | H | H | H | H | $CON(CH_2CH(C_2H_5)C_4H_9)_2$ |
| 26 | Ph | $NH_2$ | OH | H | H | CONBnPh | H | H |
| 27 | Ph | $NH_2$ | OH | H | H | F | $CON(CH_2CH(C_2H_5)C_4H_9)_2$ | H |
| 28 | Ph | NHPh | OH | H | H | I | H | $CON(CH_2CH(C_2H_5)C_4H_9)_2$ |
| 29 | Ph | 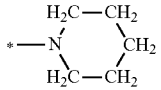 | OH | H | Br | H | H | $CON(CH_2CH(C_2H_5)C_4H_9)_2$ |
| 30 | Ph | $NH_2$ | OH | Cl | H | Cl | H | $CON(CH_2CH(C_2H_5)C_4H_9)_2$ |
| 31 | Ph | COONa | OH | $CH_3$ | H | Cl | H | $CON(CH_2CH(C_2H_5)C_4H_9)_2$ |
| 32 | Ph | COONa | OH | H | H | OH | H | $CON(CH_2CH(C_2H_5)C_4H_9)_2$ |
| 33 | Ph | COONa | OH | H | $OCH_3$ | $OCH_3$ | H | $CON(CH_2CH(C_2H_5)C_4H_9)_2$ |
| 34 | Ph | COONa | OH | H | H | $CH_3$ | H | $CON(CH_2CH(C_2H_5)C_4H_9)_2$ |

TABLE 1-continued

Coloring matter compound used in the present invention:

| Comp No. | $R_1$ | $R_2$ | $R_6$ | $R_7$ | $R_8$ | $R_9$ | $R_{10}$ | $R_{11}$ |
|---|---|---|---|---|---|---|---|---|
| 35 | Ph | COONa | OH | H | H | $NO_2$ | H | $CON(CH_2CH(C_2H_5)C_4H_9)_2$ |
| 36 | Ph | COONa | OH | H | H | H | $CF_3$ | $CON(CH_2CH(C_2H_5)C_4H_9)_2$ |
| 37 | Ph | 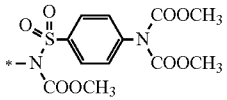 | OH | H | H | $NHCOCH_3$ | H | $CON(CH_2CH(C_2H_5)C_4H_9)_2$ |
| 38 | Ph | $NH_2$ | OH | H | H | $SO_2NH_2$ | H | $CON(CH_2CH(C_2H_5)C_4H_9)_2$ |
| 39 | Ph | COONa | OH | H | COOBn | H | H | COOBn |
| 40 | H | $NH_2$ | OH | H | H | H | H | $CON(CH_2CH(C_2H_5)C_4H_9)_2$ |
| 41 | Ph | COONa | OH | H | $CONHCH_2CH(C_2H_5)C_4H_9$ | H | H | $CONHCH_2CH(C_2H_5)C_4H_9$ |
| 42 | $CH_3$ | $NH_2$ | OH | H | H | H | H | $CON(CH_2CH(C_2H_5)C_4H_9)_2$ |
| 43 | Ph | COONa | OH | H | H | 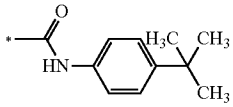 | H | H |
| 44 | Ph | COONa | OH | H | H | $CONHCH_2CH(C_2H_5)C_4H_9$ | H | H |
| 45 | Ph | $NH_2$ | OH | H | H | $CONHCH_2CH(C_2H_5)C_4H_9$ | H | H |
| 46 | Ph | $NH_2$ | OH | H | $CONHCH_2CH(C_2H_5)C_4H_9$ | H | H | $CONHCH_2CH(C_2H_5)C_4H_9$ |
| 47 | Ph | $CON(CH_2CH(CH_3)_2)_2$ | OH | $SO_3Na$ | H | H | H | H |
| 48 | Ph | $CON(CH_2CH(C_2H_5)C_4H_9)_2$ | OH | $SO_3Na$ | H | H | H | H |
| 49 | Ph | COOPh | OH | $SO_3Na$ | H | H | H | H |
| 50 | Ph | COOBn | OH | $SO_3Na$ | H | H | H | H |
| 51 | Ph | CONBnPh | OH | $SO_3Na$ | H | H | H | H |
| 52 | 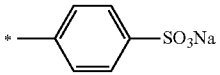 | $CONHCH_2CH(C_2H_5)C_4H_9$ | OH | H | H | H | H | H |
| 53 | Ph | $CON(C_6H_{13})_2$ | OH | $SO_3Na$ | $CONHCH_2CH(C_2H_5)C_4H_9$ | H | H | H |
| 54 | Ph | $CON(CH_2CH(CH_3)_2)_2$ | OH | $SO_3H$ | $CON(CH_2CH(C_2H_5)C_4H_9)_2$ | H | H | H |
| 55 | 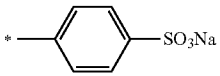 | $COOCH_2CH_3$ | OH | H | H | H | H | $CON(CH_2CH(C_2H_5)C_4H_9)_2$ |
| 56 | 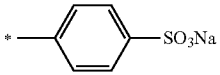 | $CON(CH_2CH(C_2H_5)C_4H_9)_2$ | OH | H | H | H | H | H |

TABLE 1-continued

Coloring matter compound used in the present invention:

| Comp No. | $R_1$ | $R_2$ | $R_6$ | $R_7$ | $R_8$ | $R_9$ | $R_{10}$ | $R_{11}$ |
|---|---|---|---|---|---|---|---|---|
| 57 | 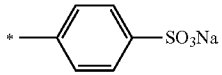 | $CON(CH_2CH(C_2H_5)C_4H_9)_2$ | OH | H | CONPhBn | H | H | H |
| 58 | 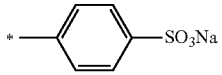 | $CON(CH_2CH(C_2H_5)C_4H_9)_2$ | OH | H | COOPh | H | H | H |
| 59 | 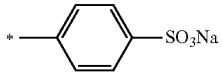 | $CON(CH_2CH(C_2H_5)C_4H_9)_2$ | OH | H | COOBn | H | H | H |
| 60 | Ph | $CON(CH_2CH(C_2H_5)C_4H_9)_2$ | OH | $SO_3Na$ | Cl | $CH_3$ | H | H |
| 61 | 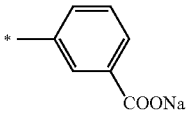 | $CON(CH_2CH(C_2H_5)C_4H_9)_2$ | OH | H | H | H | H | H |
| 62 | 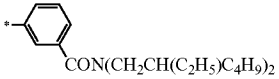 | $CON(CH_2CH(C_2H_5)C_4H_9)_2$ | OH | COOH | H | H | COOH | H |
| 63 | Ph | $CON(CH_2CH(C_2H_5)C_4H_9)_2$ | OH | COONa | H | H | H | H |
| 64 | Ph | $CON(CH_2CH(C_2H_5)C_4H_9)_2$ | OH | H | COOH | H | H | H |
| 65 | Ph | $CON(CH_2CH(C_2H_5)C_4H_9)_2$ | OH | COOH | $CF_3$ | H | H | H |
| 66 | Ph | $CON(CH_2CH(C_2H_5)C_4H_9)_2$ | OH | COOH | H | $SO_2NH_2$ | H | H |
| 67 | Ph | $CON(CH_2CH(C_2H_5)C_4H_9)_2$ | OH | COOH | H | $NHCOCH_3$ | H | H |
| 68 | Ph | $CON(CH_2CH(C_2H_5)C_4H_9)_2$ | OH | $OCH_3$ | H | H | COONa | H |
| 69 | Ph | $CH_3$ | $NH_2$ | H | H | H | H | $CON(CH_2CH(C_2H_5)C_4H_9)_2$ |
| 70 | 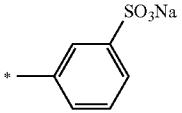 | $CH_3$ | $NH_2$ | H | H | H | H | $CON(CH_2CH(C_2H_5)C_4H_9)_2$ |
| 71 | H | $C(CH_3)_3$ | $NH_2$ | H | H | $CON(CH_2CH(C_2H_5)C_4H_9)_2$ | H | H |
| 72 | $CH_3$ | $CH_3$ | $NH_2$ | H | H | $CON(CH_2CH(C_2H_5)C_4H_9)_2$ | H | H |
| 73 | Bn | $CH_3$ | $NH_2$ | H | $CON(CH_2CH(C_2H_5)C_4H_9)_2$ | H | H | H |
| 74 | Ph | Ph | $NH_2$ | H | $CON(CH_2CH(C_2H_5)C_4H_9)_2$ | H | H | H |
| 75 | H | H | $NH_2$ | H | H | H | H | $CONHCH_2CH(C_2H_5)C_4H_9$ |

TABLE 1-continued

Coloring matter compound used in the present invention:

| Comp No. | $R_1$ | $R_2$ | $R_6$ | $R_7$ | $R_8$ | $R_9$ | $R_{10}$ | $R_{11}$ |
|---|---|---|---|---|---|---|---|---|
| 76 | Ph | $CH_3$ | $NH_2$ | H | $CONHCH_2CH(C_2H_5)C_4H_9$ | H | H | $CONHCH_2CH(C_2H_5)C_4H_9$ |
| 77 | Ph | $CH(CH_3)_2$ | $NH_2$ | H | H | $CON(CH_2)Ph$ | H | H |
| 78 | Ph | 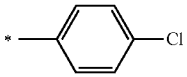 | $NH_2$ | H | H | $CON(Bn)_2$ | H | H |
| 79 | 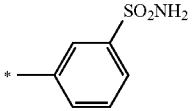 | 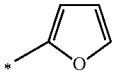 | $NH_2$ | H | H | $CON(CH(CH_3)_2)_2$ | H | H |
| 80 | Ph | $CH_3$ | $NH_2$ | H | H | $NO_2$ | H | $CON(CH_2CH(C_2H_5)C_4H_9)_2$ |
| 81 | Ph | $CH_3$ | $NH_2$ | H | H | H | $CF_3$ | $CON(CH_2CH(C_2H_5)C_4H_9)_2$ |
| 82 | Ph | $CH_3$ | $NH_2$ | H | H | OH | H | $CON(CH_2CH(C_2H_5)C_4H_9)_2$ |
| 83 | Ph | 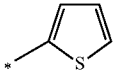 | $NH_2$ | $CH_3$ | H | Cl | H | $CON(CH_2CH(C_2H_5)C_4H_9)_2$ |
| 84 | Ph | $CH_3$ | $NH_2$ | H | H | F | H | $CON(CH_2CH(C_2H_5)C_4H_9)_2$ |
| 85 | Ph | $CH_3$ | $NH_2$ | H | H | Br | H | $CON(CH_2CH(C_2H_5)C_4H_9)_2$ |
| 86 | Ph | $CH_3$ | $NH_2$ | H | H | I | H | $CON(CH_2CH(C_2H_5)C_4H_9)_2$ |
| 87 | Ph | $CH_3$ | $NH_2$ | H | $OCH_3$ | $OCH_3$ | H | $CON(CH_2CH(C_2H_5)C_4H_9)_2$ |
| 88 | Ph | $CH_3$ | $NH_2$ | H | H | $NHCOCH_3$ | H | $CON(CH_2CH(C_2H_5)C_4H_9)_2$ |
| 89 | Ph | $CH_3$ | $NH_2$ | H | H | $SO_2NH_2$ | H | $CON(CH_2CH(C_2H_5)C_4H_9)_2$ |

The medium in which the coloring matter compound is to be dispersed is described here. The medium is, unless particularly noted, meant by a medium standing liquid, solid or intermediate therebetween that is chiefly made up of an organic matter, as exemplified by an organic solvent, a resin, a polymerizable monomer or a wax. Any of these may be used alone or in combination.

As types of the organic solvent as the medium used in the present invention, it may include, but is not particularly limited to, e.g., alcohols such as methanol, ethanol and propanol; ketones such as acetone, methyl ethyl ketone and methyl isobutyl ketone; esters such as methyl acetate, ethyl acetate and propyl acetate; ethers such as diethyl ether, tetrahydrofuran and dioxane; hydrocarbons such as benzene, toluene, xylene, hexane and heptane; halogen-containing hydrocarbons such as dichloromethane, dichloroethane and chloroform; amides such as N,N-dimethylformamide and N,N-dimethylimidazolidinone; nitriles such as acetonitrile and propionitrile; and acids such as formic acid, acetic acid and propionic acid.

As types of the resin, polymerizable monomer and wax as the medium used in the present invention, they may include, but is not particularly limited to, components used as materials for toner which are described later.

Constituents other than the coloring matter compound in the yellow toner of the present invention are described next.

The yellow toner of the present invention is a toner comprising toner base particles having a binder resin, a colorant and a wax component, and is characterized by containing at least as the colorant the coloring matter compound represented by the general formula (1) and the pigment represented by the formula (2).

The pigment represented by the formula (2) is C.I. Pigment Yellow 155, and has a high affinity for the coloring matter compound represented by the general formula (1). Then, the coloring matter compound represented by the general formula (1) has a high affinity for mediums, and hence the use of the both in combination makes the pigment well dispersible in the binder resin or in the polymerizable monomer.

As methods by which the toner according to the present invention is produced, any known methods may be used, such as the pulverization process disclosed in Japanese Patent Publication No. S36-10231, in which the binder resin, the colorant according to the present invention, the wax component and so forth are melt-kneaded by means of a heat kneader or the like, thereafter the kneaded product, having been cooled, is finely pulverized to have the desired particle diameter, and the finely pulverized product is further classified to control its particle size distribution to obtain the toner; the method disclosed in Japanese Patent Applications Laid-open No. S59-53856 and No. S59-61842, in which the toner is directly produced by suspension polymerization; the suspension granulation process disclosed in Japanese Patent Application Laid-open No. H11-184146, in which the binder resin, the colorant and a release agent (and optionally a magnetic material, a charge control agent and other additives) are mixed in a solvent having no affinity for water, the pigment composition obtained is suspended in an aqueous medium and the solvent is removed from the suspension obtained to produce spherical toner particles; the method disclosed in Japanese Patent Publication No. S56-13945, in which a molten kneaded product is atomized in the air by means of a disk or multiple fluid nozzles to obtain spherical toner particles; and an emulsion polymerization process as typified by soap-free polymerization.

The coloring matter compound represented by the general formula (1) according to the present invention has the property that it has a high affinity for organic mediums, in particular, a high solubility in organic solvents, and hence it may especially preferably be used when the toner base particles in the present invention are produced by the suspension polymerization or suspension granulation (solution polymerization), which goes through a step where it comes into contact with the organic solvent (or the polymerizable monomer). The coloring matter compound represented by the general formula (1), which serves as a dispersant of the pigment represented by the formula (2), has a high solubility in the organic solvent for the former, and hence enables the pigment to be dispersed in oil droplets containing an organic medium, in a closely uniform state.

A compound which is low migratory to water may also be used as the coloring matter compound represented by the general formula (1), where it can keep the pigment from migrating to the aqueous medium and hence can especially well be effective in producing the toner base particles by the suspension polymerization or suspension granulation (solution polymerization).

The coloring matter compound represented by the general formula (1) may preferably be used in an amount of from 0.1 part by mass to 20 parts by mass, and much preferably from 1.0 part by mass to 10 parts by mass, based on 100 parts by mass of the pigment represented by the formula (2). Its use in such a proportion can well improve in dispersibility of the pigment represented by the formula (2).

The binder resin of toner that is used in the present invention may include a styrene-acrylic acid copolymer, polyester resins, epoxy resins and a styrene-butadiene copolymer, which are commonly used. In the method of obtaining the toner base particles directly by polymerization, monomers for forming them are used. Stated specifically, preferably usable are styrene; styrene monomers such as o-, m- or p-methylstyrene and m- or p-ethylstyrene; methacrylate monomers such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, and diethylaminoethyl methacrylate; acrylate monomers such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, and diethylaminoethyl acrylate; butadiene, isoprene, cyclohexene, methacrylonitrile, and acrylic acid amide.

Any of these monomers may be used alone, or commonly in the form of an appropriate mixture of monomers which are so mixed that the theoretical glass transition temperature (Tg) as described in a publication POLYMER HANDBOOK, 2nd Edition III, pp. 139-192 (John Wiley & Sons, Inc.) may range from 40° C. to 75° C.

As long as the theoretical glass transition temperature is within the above range, good storage stability and running stability required as the toner can be achieved, and also good transparency can be achieved in the case of full-color image formation.

The wax may specifically include petroleum waxes and derivatives thereof such as paraffin wax, microcrystalline wax and petrolatum; montan wax and derivatives thereof; hydrocarbon waxes obtained by Fischer-Tropsch synthesis, and derivatives thereof; polyolefin waxes typified by polyethylene wax, and derivatives thereof; and naturally occurring waxes such as carnauba wax and candelilla wax, and derivatives thereof. The derivatives include oxides, block copolymers with vinyl monomers, and graft modified products.

Also usable are alcohols such as higher aliphatic alcohols, fatty acids such as stearic acid and palmitic acid, or compounds thereof, acid amide waxes, ester waxes, ketones, hardened caster oil and derivatives thereof, vegetable waxes, and animal waxes. Any of these may be used alone or in combination.

As the charge control agent, which may optionally be added, preferred are colorless agents in view of color development. For example, as a charge control agent for negative charging, it may include metal compounds of aromatic carboxylic acids such as salicylic acid, alkylsalicylic acids, dialkylsalicylic acids, naphthoic acid and dicarboxylic acids; metal salts or metal complexes of azo dyes or azo pigments; polymers, or copolymers, having a sulfonic acid group, a sulfonic salt group or a sulfonic ester group; boron compounds, urea compounds, and carixarene. As a charge control agent for positive charging, it may include compounds having a quaternary ammonium salt structure, and triphenylmethane compounds.

For the purpose of providing the toner with fluidity, charge controllability and so forth, inorganic fine particles or organic fine particles may externally be added. What may preferably be used as the fine particles to be externally added are fine silica particles and fine titanium particles the particle surfaces of which have been treated with a coupling agent containing an alkyl group. Any of these may preferably be those having a number average primary particle diameter of from 10 nm to 50 nm, and further may preferably be added to the toner in an amount of from 0.1% by mass to 20% by mass.

Where the yellow toner of the present invention is used in a two-component developer, it is used together with a carrier. As the carrier, it may be a non-coated carrier made up of only particles of a magnetic material such as iron or ferrite or a resin-coated carrier obtained by coating the surfaces of such magnetic-material particles with a resin, either of which may be used. The carrier may preferably have a volume average particle diameter of from 30 μm to 150 μm.

As an image forming method in which the yellow toner of the present invention may be used, there are no particular limitations thereon. For example, the yellow toner of the present invention may be used in a method in which toner images are repeatedly formed on a photosensitive member and thereafter transferred to an image forming member such as paper, followed by fixing to form an image.

The yellow toner of the present invention may also be used in a method in which color toner images formed on a photosensitive member are successively transferred to an intermediate transfer member and thereafter transferred to an image forming member such as paper, followed by fixing to form a color image.

EXAMPLES

The present invention is described below in greater detail by giving Examples and Comparative Examples. The present invention is by no means limited to these Examples. In the following, what are expressed as "part(s)" and "%" are by mass unless particularly noted.

Coloring Matter Compound

Synthesis Example 1

A coloring matter compound represented by the following formula (10) in the general formula (1) was obtained in the following way.

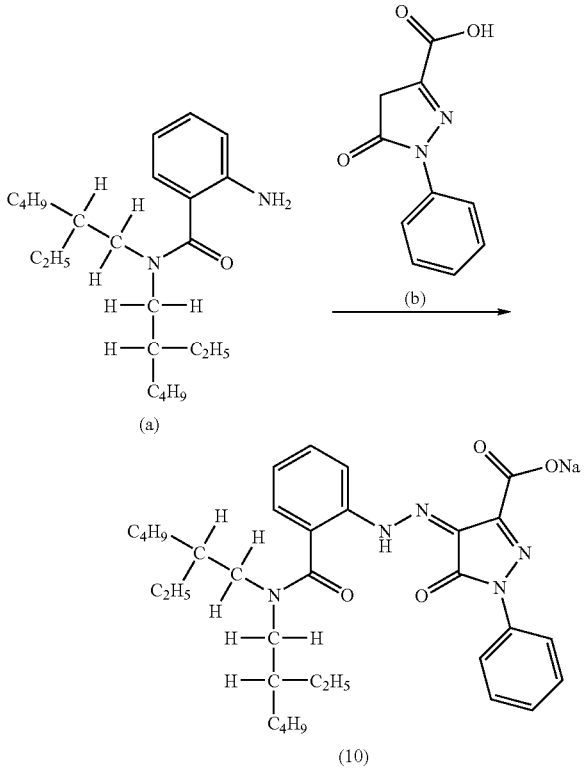

To 5.0 parts of the compound of the formula (a), 3.96 parts of concentrated hydrochloric acid and 50 parts of methanol were added, and these were ice-cooled to 10° C. or less. To the solution obtained, a solution prepared by dissolving 0.977 part of sodium nitrite in 10.0 parts of water was added, and these were reacted at the same temperature for 1 hour. Then, to the reaction mixture obtained, 0.186 part of sulfamic acid was added, and these were further stirred for 30 minutes (a diazonium salt solution).

Next, to 2.37 parts of the compound of the formula (b) (available from Aldrich Chemical Co., Inc.), 100 parts of methanol was added to dissolve therein the former, and thereafter 6.75 parts of a saturated aqueous sodium carbonate solution was added thereto. This was added to the above diazonium salt solution, kept cooled to 10° C. or less. Thereafter, the reaction was carried out at 10° C. or less for 2 hours.

After the reaction was completed, the methanol was evaporated off, and the product was extracted with chloroform, and then washed with saturated brine, followed by concentration. This was re-precipitated with chloroform-n-heptane to obtain 5.65 parts of the coloring matter compound represented by the formula (10). The coloring matter compound obtained was examined for its purity by HPLC, and thereafter its structure was determined by making NMR analysis and mass spectrometry. The results of analysis are shown below. An NMR spectrum obtained by the NMR analysis of the coloring matter compound (10) is shown in FIG. 1.

—Analytical Results on Coloring Matter Compound (10)—

Results of HPLC Purity: area 99.6%; retention time: 28.5 minutes (0.1 mM TFA solution-MeOH).

Results of ESI-TOF-MS m/z: 598.338 $(M+H)^+$.

Results of $^1$H-NMR (400 MHz, DMSO-$d_6$, room temperature)

δ (ppm): 18.25 (1H, s), 8.03 (2H, d), 7.74 (1H, d), 7.51-7.43 (3H, m), 7.26-7.18 (3H, m), 4.09 (1H, dd), 3.17 (1H, dd), 2.86 (2H, dd), 1.81 (1H, s), 1.39-0.40 (29H, m).

Coloring Matter Compound

Synthesis Example 2

A coloring matter compound represented by the following formula (63) in the general formula (1) was obtained in the following way.

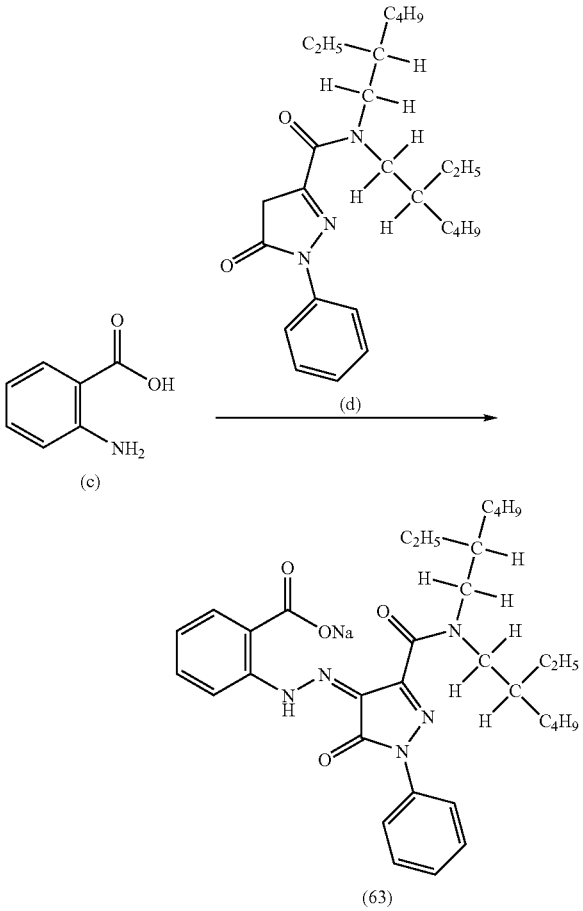

To 5.0 parts of the compound of the formula (c), 7.4 parts of concentrated hydrochloric acid and 25 parts of methanol were added, and these were ice-cooled to 10° C. or less. To the solution obtained, a solution prepared by dissolving 2.6 parts of sodium nitrite in 7.8 parts of water was added, and these were reacted at the same temperature for 1 hour. Then, to the reaction mixture obtained, 0.53 part of sulfamic acid was added, and these were further stirred for 20 minutes (a diazonium salt solution).

Figure 2:
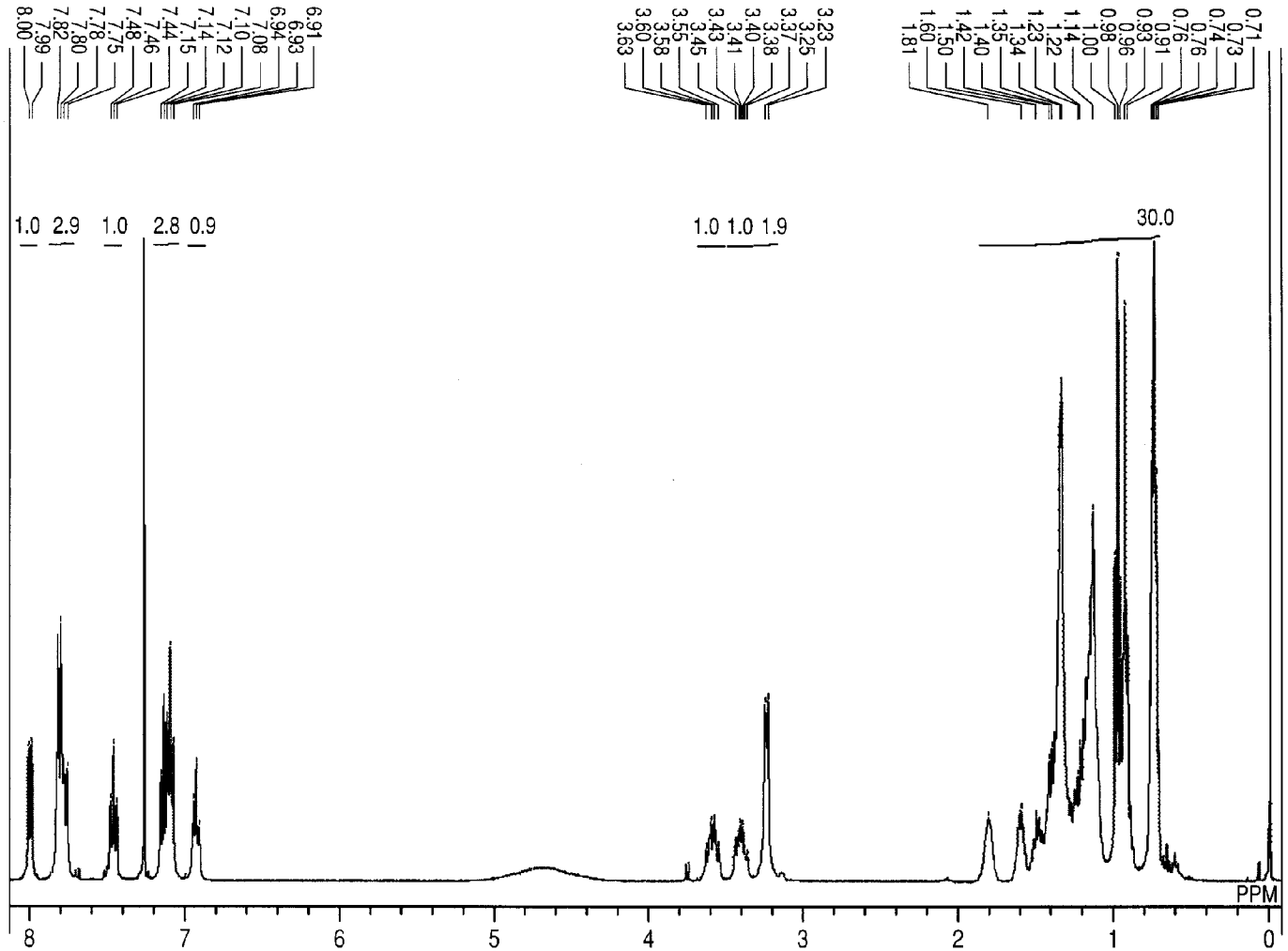
FIG. 2 is a graph showing a $^1$H-NMR spectrum in $CDCl_3$, at room temperature and at 400 MHz, of a coloring matter compound (63) used in the yellow toner of the present invention.

To 15 parts of the compound of the formula (d), parts of methanol was added to dissolve therein the former, and these were ice-cooled to 10° C. or less, where the above diazonium salt solution was added thereto. Thereafter, a saturated aqueous sodium acetate solution was added to adjust the pH to 5 to 7, and the reaction was carried out at 10° C. or less for 2 hours. After the reaction was completed, the reaction product was purified by recrystallization to obtain 17 parts of the coloring matter compound represented by the formula (63). The results of analysis of the coloring matter compound (63) are shown below. An NMR spectrum obtained by the NMR analysis of the coloring matter compound (63) is shown in FIG. 2.

—Analytical Results on Coloring Matter Compound (63)—

Results of HPLC Purity: area 99.0%; retention time: 31.6 minutes (0.1 mM TFA solution-MeOH).

Results of ESI-TOF-MS m/z: 596.33 $(M-Na)^-$.

Results of $^1$H-NMR (400 MHz, $CDCl_3$, room temperature) δ (ppm): 7.99 (1H, d), 7.88-7.71 (3H, m), 7.46 (1H, t), 7.16-7.08 (3H, m), 6.93 (1H, t), 3.68-3.51 (1H, m), 3.50-3.33 (1H, m), 3.24 (2H, d), 1.81-0.71 (30H, m).

Coloring Matter Compound

Synthesis Example 3

A coloring matter compound represented by the following formula (69) in the general formula (1) was obtained in the following way.

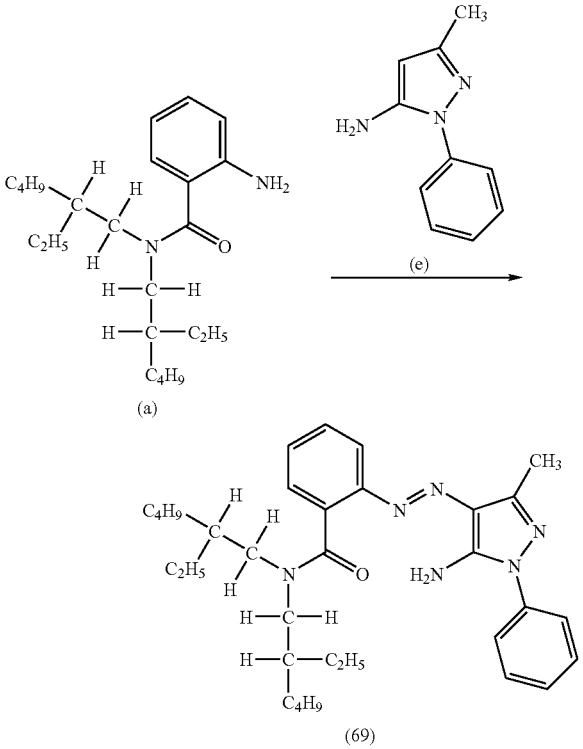

To 3.0 parts of the compound of the formula (a), 2.0 parts of concentrated hydrochloric acid and 24 parts of methanol were added, and these were stirred at 5° C. or less. To the solution obtained, a solution prepared by dissolving 0.6 part of sodium nitrite in 10 parts of water was dropwise added, and these were reacted at the same temperature for 1 hour. Then, to the reaction mixture obtained, 0.1 part of sulfamic acid was added, and these were further stirred for 30 minutes (a diazonium salt solution).

Figure 3:
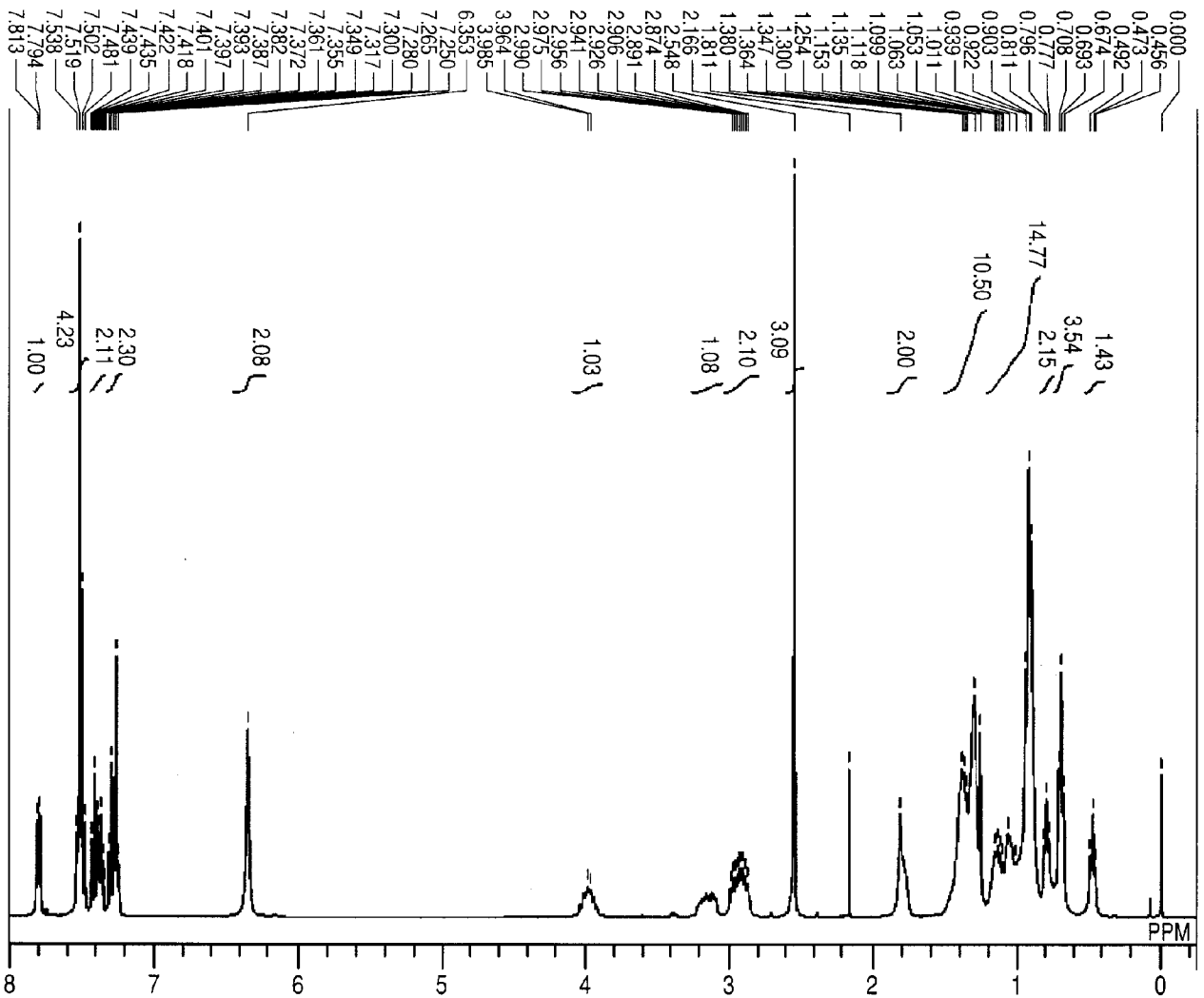
FIG. 3 is a graph showing a $^1$H-NMR spectrum in $CDCl_3$, at room temperature and at 400 MHz, of a coloring matter compound (69) used in the yellow toner of the present invention.

To 1.4 parts of the compound of the formula (e), 4.1 parts of sodium carbonate and 40 parts of methanol were added, and these were stirred at 5° C. or less, where the above diazonium salt solution was added thereto to carry out reaction overnight. After the reaction was completed, the methanol was evaporated off, and the product was extracted with chloroform, and then washed with saturated brine, followed by concentration. This was re-precipitated with chloroform-n-heptane to obtain 3.3 parts of the coloring matter compound represented by the formula (69). The results of analysis of the coloring matter compound (69) are shown below. An NMR spectrum obtained by the NMR analysis of the coloring matter compound (69) is shown in FIG. 3.

—Analytical Results on Coloring Matter Compound (69)—

Results of HPLC Purity: area 96.8%; retention time: 30.93 minutes (0.1 mM TFA solution-MeOH).

Results of ESI-TOF-MS m/z: 545.412 $(M+H)^+$.

Results of $^1$H-NMR (400 MHz, $CDCl_3$, room temperature) δ (ppm): 7.80 (1H, d), 7.54-7.48 (4H, m), 7.44-7.35 (2H, m), 7.32-7.25 (2H, m), 6.35 (2H, s), 3.99-3.96 (1H, m), 3.21-3.05 (1H, m), 2.99-2.87 (2H, m), 2.55 (3H, s), 1.81 (2H, brs), 1.38-0.47 (28H, m).

Other Coloring Matter Compounds

Synthesis Examples

The procedure corresponding to any of the above Synthesis Examples 1 to 3 was so repeated as to make the $R^1$, $R^2$ and $R^6$ to $R^{11}$ in the general formula (1) into those shown in Table 1, to synthesize coloring matter compounds (II) to (89). Structures of these coloring matter compounds were determined by HPLC analysis, mass spectrometry and NMR analysis in the same way as those of the above coloring matter compounds (10), (63) and (69).

Example 1

The yellow toner of the present invention was produced according to the formulation shown below.

Yellow Toner Production Example 1

(Suspension Polymerization)

| | |
|---|---|
| Styrene monomer | 120 parts |
| Colorant of formula (2) | 12 parts |
| Coloring matter compound (10) | 0.12 part |

A mixture of the above was put to dispersion for 3 hours by means of an attritor (manufactured by Nippon Coke & Engineering Co., Ltd.) to prepare a pigment dispersion (α).

Into a 2-liter four-necked flask having a high-speed stirrer TK homomixer (manufactured by Tokushu Kika Kogyo Co., Ltd.), 710 parts of ion-exchanged water and 450 parts of an aqueous 0.1 mol/L $Na_3PO_4$ solution were introduced, and these were heated to 60° C., controlling the number of revolutions of the homomixer at 12,000 rpm. To the resultant mixture, 68 parts of an aqueous 1.0 mol/L $CaCl_2$ solution was slowly added to prepare an aqueous dispersion medium containing fine sparingly water-soluble dispersant $Ca_3(PO_4)_2$.

| | |
|---|---|
| Pigment dispersion (α) | 132 parts |
| Styrene monomer | 46 parts |
| n-Butyl acrylate monomer | 34 parts |
| Polar resin (polycondensation product of propylene oxide modified bisphenol A with isophthalic acid; glass transition temperature Tg: 65° C.; weight average molecular weight Mw: 10,000; number average molecular weight Mn: 6,000) | 10 parts |

-continued

| | |
|---|---|
| Low-melting substance (ester wax compound; peak temperature of maximum endothermic peak in DSC measurement: 70° C.; Mn: 704) | 25 parts |
| 3,5-Di-t-butylsalicylic acid aluminum compound (BONTRON E-88, available from Orient Chemical Industries, Ltd.) | 2 parts |
| Divinylbenzene | 0.1 part |

What was composed as above was heated to 60° C. and put to uniform dissolution and dispersion by means of the TK homomixer at 5,000 rpm. In this, 10 parts of a polymerization initiator 2,2'-azobis(2,4-dimethylvaleronitrile) was dissolved to prepare a polymerizable monomer composition.

This polymerizable monomer composition was introduced into the above aqueous dispersion medium to carry out granulation for 15 minutes while keeping the number of revolutions of 12,000 rpm. Thereafter, the high-speed stirrer was changed for a stirrer having propeller stirring blades, and, keeping its internal temperature at 60° C., the polymerization was continued for 5 hours. Thereafter, the internal temperature was raised to 80° C., and the polymerization was continued for 8 hours. After the polymerization was completed, residual monomers were evaporated off at 80° C. under reduced pressure, followed by cooling to 30° C. to obtain a fine polymer particle dispersion.

Next, the polymer fine-particle dispersion was moved to a washing container, and diluted hydrochloric acid was added thereto with stirring. With adjustment of pH to 1.5, the mixture obtained was stirred for 2 hours to dissolve a compound of phosphoric acid and calcium, containing $Ca_3(PO_4)_2$, followed by solid-liquid separation by means of a filter to obtain fine polymer particles.

The fine polymer particles obtained were put to re-dispersion in water and solid-liquid separation which were repeated until the compound of phosphoric acid and calcium, containing $Ca_3(PO_4)_2$, was completely removed, followed by solid-liquid separation carried out finally. The fine polymer particles thus obtained were dried to obtain yellow toner base particles.

In 100 parts of the yellow toner base particles obtained, 1.0 part of hydrophobic fine silica powder having been surface-treated with hexamethyldisilazane, 0.15 part of fine rutile titanium oxide powder (number average primary particle diameter: 45 nm) and 0.5 part of fine rutile titanium oxide powder (number average primary particle diameter: 200 nm) were dry-process mixed for 5 minutes by means of Henschel mixer (manufactured by Nippon Coke & Engineering Co., Ltd.) to obtain a yellow toner (A).

Yellow Toner Production Example 2

(Suspension Granulation)

Preparation of Pigment Dispersion:

| | |
|---|---|
| Ethyl acetate | 180 parts |
| Colorant of formula (2) | 12 parts |
| Coloring matter compound (10) | 0.12 part |

A mixture of the above was put to dispersion for 3 hours by means of an attritor (manufactured by Nippon Coke & Engineering Co., Ltd.) to prepare a pigment dispersion (β).

Mixing Step

| | |
|---|---|
| Pigment dispersion (β) | 96.0 parts |
| Polar resin (saturated polyester; polycondensation product of propylene oxide modified bisphenol A with phthalic acid; Tg: 75.9° C.; Mw: 11,000; Mn: 4,200; acid value: 11) | 85.0 parts |
| Hydrocarbon wax (Fischer-Tropsch wax; peak temperature of maximum endothermic peak in DSC measurement: 80° C.; Mw: 750) | 9.0 parts |
| 3,5-Di-t-butylsalicylic acid aluminum compound (BONTRON E-88, available from Orient Chemical Industries, Ltd.) | 2.0 parts |
| Ethyl acetate (solvent) | 10.0 parts |

What was composed as above was put to dispersion for 24 hours by means of a ball mill to obtain 200 parts of a toner composition liquid mixture.

Dispersion Suspension Step

| | |
|---|---|
| Calcium carbonate (coated with acrylic-acid copolymer) | 20.0 parts |
| Carboxymethyl cellulose (trade name: CELLOGEN BS-H, available from Dai-ichi Kogyo Seiyaku Co., Ltd.) | 0.5 part |
| Ion-exchanged water | 99.5 parts |

What was composed as above was put to dispersion for 24 hours by means of a ball mill to dissolve the carboxymethyl cellulose to obtain an aqueous medium.

Then, 1,200 g of the aqueous medium thus obtained was put into TK-homomixer, and stirred rotating a rotating blade at a peripheral speed of 20 m/sec, during which 1,000 g of the above toner composition liquid mixture was introduced thereinto. These were stirred for 1 minute while keeping temperature constantly at 25° C. to obtain a suspension.

Solvent Removal Step 2,200 g of the suspension obtained in the dispersion suspension step was stirred by means of Full-zone blade (manufactured by Shinko Pantec Co., Ltd.) at a peripheral speed of 45 m/min, during which, keeping the temperature constantly at 40° C., the gaseous phase on the suspension liquid level was forcedly renewed by using a blower to start to remove the solvent. In that course, after 15 minutes from the start of solvent removal, 75 g of ammonia water diluted to 1% was added as an ionic substance. Subsequently, after 1 hour from the start of solvent removal, 25 g of the like ammonia water was added. Subsequently, after 2 hours from the start of solvent removal, 25 g of the like ammonia water was added. Finally, after 3 hours from the start of solvent removal, 25 g of the like ammonia water was added, thus 150 g of the ammonia water was added in total. Further, keeping the temperature at 40° C., the system was held for 17 hours from the start of solvent removal. Thus, a toner dispersion was obtained in which the solvent (ethyl acetate) was removed from suspended particles.

Washing and Dehydration Step

To 300 parts of the toner dispersion obtained in the solvent removal step, 80 parts of 10 mol/l hydrochloric acid was added, followed by further addition of an aqueous 0.1 mol/L sodium hydroxide solution to carry out neutralization treatment. Thereafter, washing with ion-exchanged water by suction filtration was repeated four times to obtain a toner cake. The toner cake thus obtained was dried by means of a vacuum dryer, followed by sifting through a 45-μm mesh sieve to obtain yellow toner base particles. Subsequent procedure in Toner Production Example 1 was repeated to obtain a yellow toner (B).

Other Yellow Toners

Production Examples

Yellow toners (C) to (L) and (N) to (T) of the present invention were obtained in the same way as in Yellow Toner Production Example 1 except that the coloring matter compound (10) was respectively changed for the coloring matter compounds shown in Table 2.

Yellow toners (M) and (U) of the present invention were also obtained in the same way as in Yellow Toner Production Example 2 except that the coloring matter compound (10) was changed for the coloring matter compounds (55) and (78), respectively.

Comparative Yellow Toner

Production Example 1

A comparative yellow toner (V) was obtained in the same way as in Yellow Toner Production Example 1 except that the coloring matter compound (10) was not added.

Comparative Yellow Toner

Production Example 2

A comparative yellow toner (W) was obtained in the same way as in Yellow Toner Production Example 2 except that the coloring matter compound (10) was not added.

Other Comparative Yellow Toners

Production Examples

Comparative yellow toners (X) and (Y) were obtained in the same way as in Yellow Toner Production Example 1 except that the coloring matter compound (10) was changed for a comparative compound represented by the following formula (90) and a comparative compound (91), SOLSPERSE 24000SC (registered trademark; available from Lubrizol Corporation), respectively.

Formula (90)

(90)

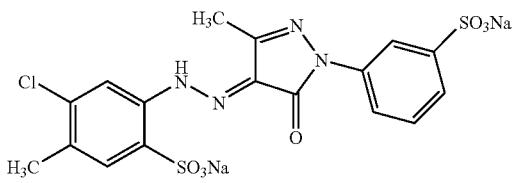

The coloring matter compounds used and the yellow toners obtained in the present invention and those in comparative examples were measured and evaluated in the following way.

Evaluation on Migration to Water of Coloring Matter Compound 100 parts of each yellow toner was added to 500 parts of an aqueous medium, and these were stirred with stirring blades at room temperature for 24 hours. Any spread of color into the aqueous medium in that course was visually examined to make evaluation. The evaluation was not made in regard to the yellow toners (V) and (W) as not making use of any coloring matter compound having a high migration to water.

A: The aqueous medium stands colorless.

B: The aqueous medium stands slightly colored.

C: The aqueous medium stands clearly colored.

Measurement of Particle Diameter of Toner Particles

As a surface-active agent about 0.5 ml of a dodecylbenzenesulfonate was added to about 100 ml of an 1% aqueous sodium chloride solution, and as a measuring sample about 5 mg of the above yellow toner particles were further added thereto to prepare a sample dispersion. This sample dispersion was put to dispersion treatment for about 1 minute by means of an ultrasonic dispersion machine, where, in regard to particles of 2 to 40 μm in particle diameter, their particle size distribution was measured on the basis of volume by means of Coulter Multisizer (Beckman Coulter, Inc.) with 100 μm aperture. Then, 50% volume particle diameter $D_{50}$ was calculated from the results of measurement.

A: The value of $D_{50}$ is less than 6 μm.

B: The value of $D_{50}$ is 6 μm or more to less than 7.5 μm.

C: The value of $D_{50}$ is 7.5 μm or more.

Evaluation of Coloring of Toner

In a normal environment (temperature 25° C./humidity 60% RH), 16-gradation image samples controlled to be 0.45 mg/cm$^2$ in maximum toner laid-on level were prepared by using a conversion machine of a color copying machine CLC-1100 (manufactured by CANON INC.; a fixing oil application mechanism was removed). Here, CLC Color Copy Paper (available from CANON INC.) was used as sheet paper for forming thereon the image samples. The image samples obtained were analyzed with SPECTROLINO (manufactured by Gretag Macbeth Holding AG). The results of analysis were evaluated by yellow color density OD(Y). Here, the better dispersible the coloring is, the higher coloring powder the toner can have, and also the less migratory to water the pigment is, the higher coloring power the toner can have.

A: The OD(Y) is 1.6 or more.

B: The OD(Y) is 1.5 or more to less than 1.6.

C: The OD(Y) is less than 1.5.

The results of evaluation on the migration to water of coloring matter compound, measurement of 50% volume particle diameter of toner particles and evaluation of coloring of toner are shown in Table 2.

TABLE 2

Migration to Water of Coloring Matter Compound, Particle Diameter of Toner Particles & Coloring Evaluation

| Toner | Compound No. | Migration to water | $D_{50}$ diameter (μm)/ evaluation | Coloring power (OD)/ evaluation | Toner production process |
|---|---|---|---|---|---|
| A | 10 | A | 5.1/A | 1.70/A | Sus. polzn. |
| B | 10 | A | 5.2/A | 1.69/A | Sus. grnln. |
| C | 16 | A | 5.6/A | 1.72/A | Sus. polzn. |
| D | 22 | B | 5.3/A | 1.53/B | Sus. polzn. |
| E | 23 | B | 6.9/B | 1.54/B | Sus. polzn. |
| F | 40 | B | 6.4/B | 1.56/B | Sus. polzn. |
| G | 42 | B | 6.9/B | 1.54/B | Sus. polzn. |
| H | 45 | A | 7.1/B | 1.75/A | Sus. polzn. |
| I | 46 | A | 5.5/A | 1.53/B | Sus. polzn. |
| J | 47 | B | 5.4/A | 1.52/B | Sus. polzn. |
| K | 48 | A | 5.5/A | 1.55/B | Sus. polzn. |
| L | 54 | A | 6.6/B | 1.70/A | Sus. polzn. |
| M | 55 | B | 7.3/B | 1.55/B | Sus. grnln. |
| N | 62 | A | 5.4/A | 1.71/A | Sus. polzn. |
| O | 63 | A | 5.5/A | 1.72/A | Sus. polzn. |
| P | 69 | A | 5.3/A | 1.69/A | Sus. polzn. |

TABLE 2-continued

Migration to Water of Coloring Matter Compound, Particle Diameter of Toner Particles & Coloring Evaluation

| Toner | Compound No. | Migration to water | $D_{50}$ diameter (μm)/ evaluation | Coloring power (OD)/ evaluation | Toner production process |
|---|---|---|---|---|---|
| Q | 70 | B | 5.4/A | 1.71/A | Sus. polzn. |
| R | 71 | B | 7.3/B | 1.56/B | Sus. polzn. |
| S | 72 | A | 6.4/B | 1.57/B | Sus. polzn. |
| T | 77 | A | 5.6/A | 1.54/B | Sus. polzn. |
| U | 78 | B | 6.8/B | 1.56/B | Sus. grnln. |
| V | — | — | 8.5/C | 1.42/C | Sus. polzn. |
| W | — | — | 8.1/C | 1.40/C | Sus. grnln. |
| X | 90 | C | 7.9/C | 1.44/C | Sus. polzn. |
| Y | 91 | A | 7.9/C | 1.45/C | Sus. polzn. |

Sus. polzn.: Suspension polymerization

Sus. grnln.: Suspension granulation

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-107833, filed Apr. 27, 2009, which is hereby incorporated by reference herein in its entirety.

What is claimed is:

1. A yellow toner which comprises toner base particles having a binder resin, a colorant and a wax component;

the colorant comprising a coloring matter compound represented by the following general formula (1) and a pigment represented by the following formula (2):

General formula (1)

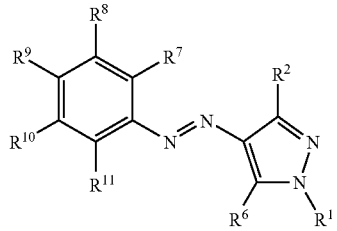

wherein;

$R^1$ represents a hydrogen atom, an alkyl group, an aryl group or an aralkyl group;

$R^2$ represents a hydrogen atom, an amino group, an alkyl group, an aryl group, a $COOR^3$ group ($R^3$ represents an alkyl group, an aryl group or an aralkyl group), a $CONR^4R^5$ group ($R^4$ represents an alkyl group, an aryl group or an aralkyl group, $R^5$ represents a hydrogen atom, an alkyl group, an aryl group or an aralkyl group, and $R^4$ and $R^5$ may form a heterocyclic ring together with a nitrogen atom) or a $COOM^1$ group ($M^1$ represents a hydrogen atom or a counter cation);

$R^6$ represents a hydroxyl group or an amino group;

$R^7$ to $R^{11}$ each independently represent a hydrogen atom, a halogen atom, a trifluoromethyl group, a nitro group, an acetylamino group, a sulfamoyl group, a hydroxyl group, an alkyl group, an alkoxyl group, a $COOR^{12}$ group ($R^{12}$ represents an alkyl group, an aryl group or an aralkyl group), a $CONR^{13}R^{14}$ group ($R^{13}$ represents an alkyl group, an aryl group or an aralkyl group, $R^{14}$ represents a hydrogen atom, an alkyl group, an aryl group or an aralkyl group, and $R^{13}$ and $R^{14}$ may form a heterocyclic ring together with a nitrogen atom), a $COOM^2$ group ($M^2$ represents a hydrogen atom or a counter cation) or an $SO_3M^3$ group ($M^3$ represents a hydrogen atom or a counter cation); and the above $R^1$ to $R^{14}$ may each be further substituted, the coloring matter compound represented by the general formula 1 must satisfy any of the following i) and ii):

i) $R^2$ is the $CONR^4R^5$ group; and ii) at least one of $R^7$ to $R^{11}$ is the $COOR^{12}$ group or $CONR^{13}R^{14}$ group; and Formula (2)

(2)

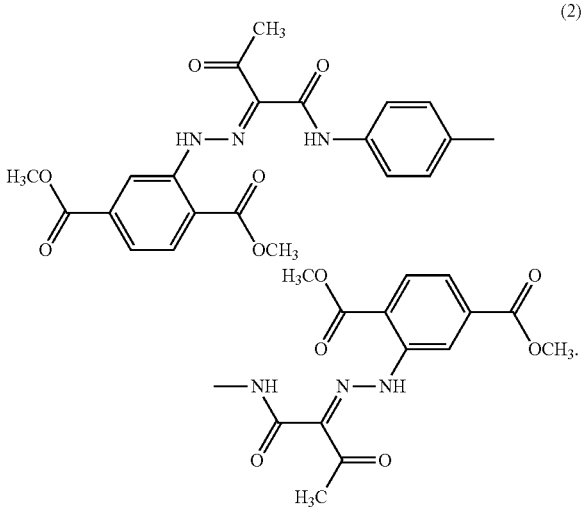

2. The yellow toner according to claim 1, wherein the $R^1$ in the general formula (1) is a phenyl group and the $R^6$ therein is the hydroxyl group.

3. The yellow toner according to claim 2, wherein the $R^2$ in the general formula (1) is the $CONR^4R^5$ group, where $R^4$ and $R^5$ are each independently the alkyl group, the aryl group or the aralkyl group.

4. The yellow toner according to claim 2, wherein the $R^2$ in the general formula (1) is the $CONR^4R^5$ group, where the total number of carbon atoms of the $R^4$ and $R^5$ is 10 or more and 16 or less.

5. The yellow toner according to claim 2, wherein one or two among the $R^7$ to $R^{11}$ in the general formula (1) is/are the $COOM^2$ group(s) and the remaining substituents among the $R^7$ to $R^{11}$ are each independently the hydrogen atom, the halogen atom, the trifluoromethyl group, the acetylamino group, the sulfamoyl group, the alkyl group, the alkoxyl group, the $COOR^{12}$ group or the $CONR^{13}R^{14}$ group.

6. The yellow toner according to claim 2, wherein the $R^2$ in the general formula (1) is the amino group or the $COOM^1$ group, at least one of the $R^7$ to $R^{11}$ is the $COOR^{12}$ group, and the number of carbon atoms of the $R^{12}$ is 8 or more and 24 or less.

7. The yellow toner according to claim 2, wherein at least one of the $R^7$ to $R^{11}$ in the general formula (1) is the $COOR^{12}$ group, where the $R^{12}$ is the alkyl group or the aralkyl group.

8. The yellow toner according to claim 2, wherein the $R^2$ in the general formula (1) is the amino group or the $COOM^1$ group, at least one of the $R^7$ to $R^{11}$ in the general formula (1) is the $CONR^{13}R^{14}$ group, and the total number of carbon atoms of the $R^{13}$ and $R^{14}$ is 8 or more and 24 or less.

9. The yellow toner according to claim 2, wherein at least one of the $R^7$ to $R^{11}$ in the general formula (1) is the $CONR^{13}R^{14}$ group, and the $R^{13}$ and $R^{14}$ are each independently the alkyl group or the aralkyl group.

10. The yellow toner according to claim 1, wherein the $R^1$ in the general formula (1) is a phenyl group and the $R^6$ therein is the amino group.

11. The yellow toner according to claim 10, wherein the $R^2$ in the general formula (1) is an alkyl group having 1 to 4 carbon atoms.

12. The yellow toner according to claim 10, wherein at least one of the $R^7$ to $R^{11}$ in the general formula (1) is the $CONR^{13}R^{14}$ group, and the total number of carbon atoms of the $R^{13}$ and $R^{14}$ is 8 or more and 24 or less.

13. The yellow toner according to claim 1, wherein the toner base particles are those produced by suspension polymerization in an aqueous medium.

14. The yellow toner according to claim 1, wherein the toner base particles are those produced by suspension granulation process in an aqueous medium.

* * * * *